US006515208B2

(12) United States Patent
Cleland

(10) Patent No.: US 6,515,208 B2
(45) Date of Patent: Feb. 4, 2003

(54) TENSIONING SYSTEM FOR A MUSICAL DRUM

(76) Inventor: Terry P. Cleland, 38 Sandringham Ct., Brampton, Ontario (CA), L6T 3Z3

( * ) Notice: Subject to any disclaimer, the term of this patent is extended or adjusted under 35 U.S.C. 154(b) by 0 days.

(21) Appl. No.: 09/876,992

(22) Filed: Jun. 11, 2001

(65) Prior Publication Data

US 2002/0029680 A1 Mar. 14, 2002

Related U.S. Application Data

(60) Provisional application No. 60/211,338, filed on Jun. 13, 2000.

(51) Int. Cl.[7] ..... G10D 13/02
(52) U.S. Cl. ..... 84/411 R; 84/419; 84/420
(58) Field of Search ..... 84/411 R, 418, 84/419, 420

(56) References Cited

U.S. PATENT DOCUMENTS

| | | | | |
|---|---|---|---|---|
| 544,125 | A | * | 8/1895 | Sapp |
| 4,060,019 | A | | 11/1977 | Cordes |
| 4,211,144 | A | | 7/1980 | May |
| 4,218,952 | A | | 8/1980 | Arbiter |
| 4,356,757 | A | | 11/1982 | Mooy |
| 4,448,105 | A | | 5/1984 | Cordes |
| 4,475,434 | A | | 10/1984 | Willis |
| 4,619,179 | A | | 10/1986 | Wright |
| 4,660,455 | A | | 4/1987 | Jones et al. |
| 4,714,002 | A | | 12/1987 | Cleland |
| 4,928,586 | A | | 5/1990 | Yanagisawa |
| 4,993,304 | A | | 2/1991 | Lovelet |
| 5,025,697 | A | | 6/1991 | May |
| RE33,685 | E | | 9/1991 | Andre et al. |
| 5,329,837 | A | | 7/1994 | Appolonia, III |
| 5,357,838 | A | | 10/1994 | Kurosaki |
| 5,377,576 | A | | 1/1995 | Good et al. |
| 5,404,785 | A | | 4/1995 | Belli |
| 5,413,022 | A | | 5/1995 | Sleishman |
| 5,447,087 | A | | 9/1995 | Hawes et al. |
| 5,723,801 | A | | 3/1998 | Hewitt |
| 5,841,049 | A | | 11/1998 | Strawn |

* cited by examiner

*Primary Examiner*—Shih-Yung Hsieh
(74) *Attorney, Agent, or Firm*—Manelli Denison & Selter; Edward J. Stemberger

(57) ABSTRACT

A drum includes a rigid, hollow body disposed about an axis and having first and second opposing opened ends of generally circular form. The body has an inner surface and an outer surface with the outer surface being of convoluted form defined by a plurality of channels formed in the body. The channels extend in a direction of the axis. A drum head membrane covers each of the first and second ends. A ring is mounted on each of the first and second ends so as to secure each drum head membrane to the body. Each ring includes a tensioning member receiving structure. A plurality of tensioning members are provided with a tensioning member being received in an associated channel and a first end of each tensioning member being received by the tensioning member receiving structure of each ring. The tensioning members are constructed and arranged to be moved with respect to the body to adjust tension of the drum head membranes.

32 Claims, 16 Drawing Sheets

TENSIONING SYSTEM FOR A MUSICAL DRUM

This application is based on U.S. provisional Application No. 60/211,338, filed on Jun. 13, 2000, and claims the benefit thereof for priority purposes.

FIELD OF THE INVENTION

The present invention relates to shell structure of a musical drum and its effect on strength, weight, appearance and tonal qualities and to the means of applying and maintaining correct tension in the members connecting the drum head membranes and shell structure.

BACKGROUND OF THE INVENTION

Musical drums have traditionally been comprised of a tube or shell with a membrane stretched over one or both ends of the tubular shape. When the membrane surface is made to vibrate by an impact from either the percussionists hand or a hand held specially designed stick, a particular tone is produced peculiar to the dimensions of the shell in combination with the qualities of the membrane. The pitch and properties of the sound produced can be influenced by the toughness of the vibrating membrane.

Early drums that used a membrane on each end of the tubular shell employed cord or rope that was laced between the two animal skin membranes to coincidentally tension these membranes or heads. The ropes eventually gave way to metal tension rods between the upper and lower vibrating heads and metal hoops to mechanically capture the edges of the skin.

The advent of the metal componentry allowed higher levels and more uniform levels of tension to be attained. As the desire for more accurate tensioning of the heads increased, the necessity to anchor the hardware to the shell to isolate the affect from the tensioning of one head over the other became apparent. New materials for the vibrating heads lead the demand for higher and higher tension requirements and consequently higher load requirements on the anchoring bracketry. The bracketry increased in size and then in number in order to spread the loads around the body of the shell.

The introduction of the aramid fiber reinforced batter head put the load requirements at a level that demanded a technology change. No matter how many brackets were employed the component failure was eminent and the weight of the overall instrument was unacceptable to the consumers. Several manufactures employed double contra tightening double hoop tensioning devices to isolate the loads completely from the shell and eliminated the brackets entirely. This tactic proved successful and has been the industry standard to date. However, a consequence of the isolation of the tension loads was a loss of sound quality due to a reduced participation of the shell in the amplification of the impact pulses from the membrane.

Accordingly, there is a need to provide a shell structure of a musical drum that will allow it to withstand the stress and stain loads placed upon it by the tensioning of the vibrating membranes.

Another issue in drum construction is the tensioning of the membranes. A typical musical drum is comprised of a hollow drum shell of cylinder-like shape, open at both ends, one or both openings being covered by a drum head membrane tensioned by means of a moveable ring engaging both membrane and tensioning cables or rods arranged around the periphery of the drum shell. When a different tension is required at each head, the tensioning member must be attached to the shell by protrusions from the shell as shown in U.S. Pat. No. 4,428,272 or to a second ring arranged within the floatable ring and bearing on the inner surface of the membrane as shown in U.S. Pat. No. 4,869,146. As better drum membrane materials allowed higher tensioning, the stresses created at the drum shell by brackets attached directly to the shell caused failures. To avoid failure, the drum shell and hardware had to be made stronger. The protrusions and shell must be made very robustly in order to resist the cantilevered load applied by the tensioning means and the drum is then very much increased in weigh and complexity, is prone to relaxation of the tension and to damage because of the bending nature of the load. These brackets also interrupt the interior of the shell decreasing the sound quality. Several methods have bean devised for avoiding these problems and in the case of U.S Pat. Nos. 4,714,002 and 4,869,146, heavy tie rods attached to rings at opposite ends of the shell avoid interruption of the shell. Use of an added inner drum head ring to react to the moveable tensioning ring loads provides the desired strength but adds to the weight and reduces the shell's participation and therefore its musical properties.

In order to improve a drum's musical properties improvements have been made to the uniformity and density of the shell as in U.S. Pat. No. 4,993,304 and to the interior surface as in U.S. Pat. No. 4,356,757 in which an inner cylindrical sleeve, flexibly suspended, is used to isolate the shell structure from the resonant cavity. These improvements are intended to enhance the response of the drum and the purity of the tone. While they do improve musical quality, they do not generally increase robustness or lightness of the shell structure and tensioning members.

The tuning of a drum has always been troublesome and time consuming since the member tension constantly changes with creep, humidity, and temperature. Furthermore, it is necessary to individually readjust the tension of each tension member to the same value.

U.S. Pat. No. 5,427,009 solves the problem of simultaneous adjustment and equal tensioning by the use of hydraulic actuators and a means for providing a pressurized fluid to the actuators but the actuators and means for providing the pressurized fluid to them adds a great deal of cost, bulk and extra weight.

A less complex but non-simultaneous means of correctly setting the tension is disclosed in U.S. Pat. No. 4,287,806 with the use of a torque indicator on each tension rod as a means of determining the amount of tension applied to each tension member. To set tension, the device relies on adjusting screw torque which is generally inexact and it must inconveniently be backed-off in order to reset the tension.

Accordingly, there is also a need to provide an improved structure to tension the membranes of a drum.

SUMMARY OF THE INVENTION

An object of the invention is to fulfill the needs referred to above. In accordance with the principles of the present invention, an objective is achieved by providing a drum shell comprising a rigid, hollow body disposed about an axis and having first and second opposing opened ends. The body has an inner surface and an outer surface. The outer surface is of convoluted form.

In accordance with another aspect of the invention, a drum includes a rigid, hollow body disposed about an axis and having first and second opposing opened ends of generally circular form. The body has an inner surface and an outer surface with the outer surface being of convoluted form defined by a plurality of channels formed in the body. The channels extend in a direction of the axis. A drum head membrane covers each of the first and second ends. A ring is mounted on each of the first and second ends so as to secure each drum head membrane to the body. Each ring includes a tensioning member receiving structure. A plurality of tensioning members are provided with a tensioning member being received in an associated channel and a first end of each tensioning member being received by the tensioning member receiving structure of each ring. The tensioning members are constructed and arranged to be moved with respect to the body to adjust tension of the drum head membranes.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

Figure 1:
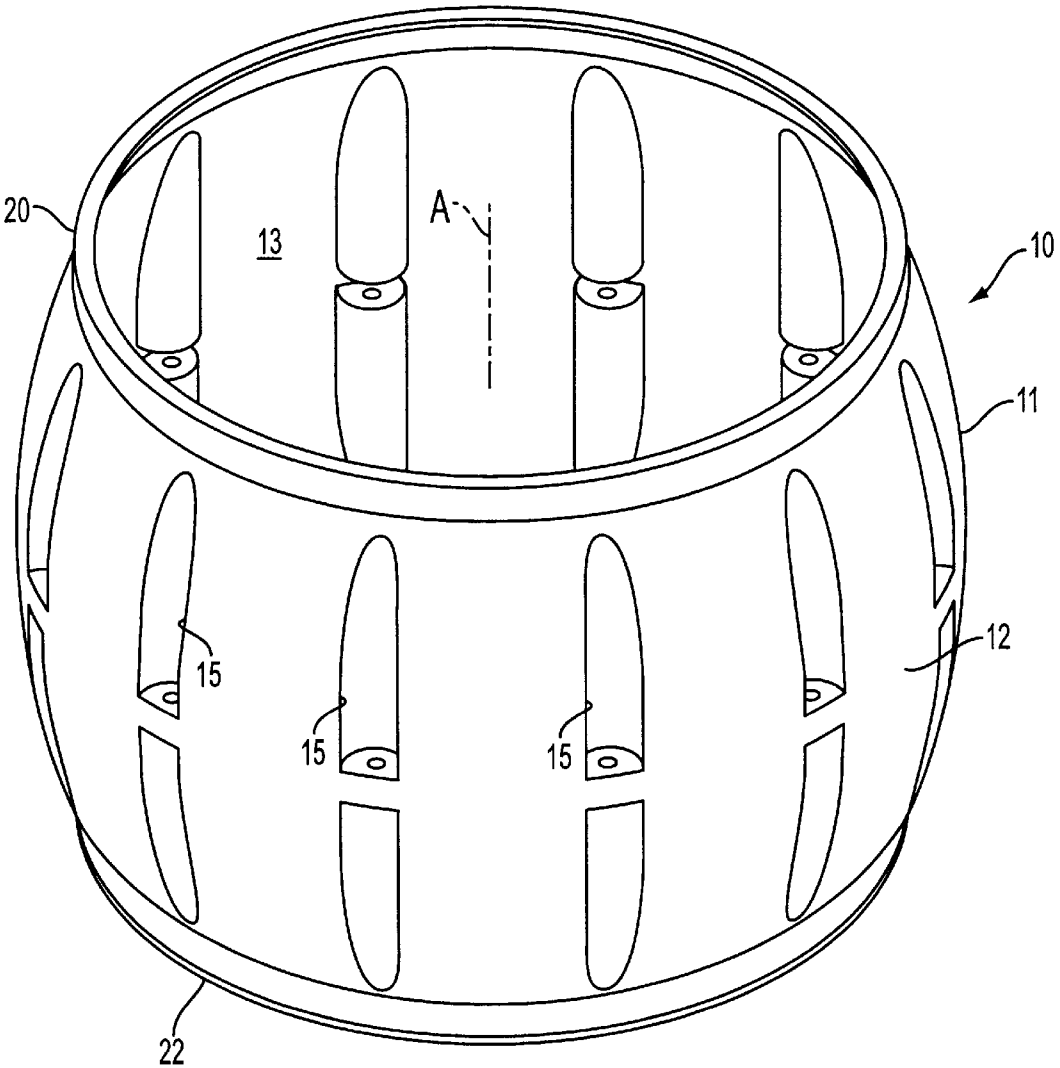
FIG. 1 is a perspective view of a drum shell of convoluted shape, provided in accordance with the principles of the present invention.
Figure 2:
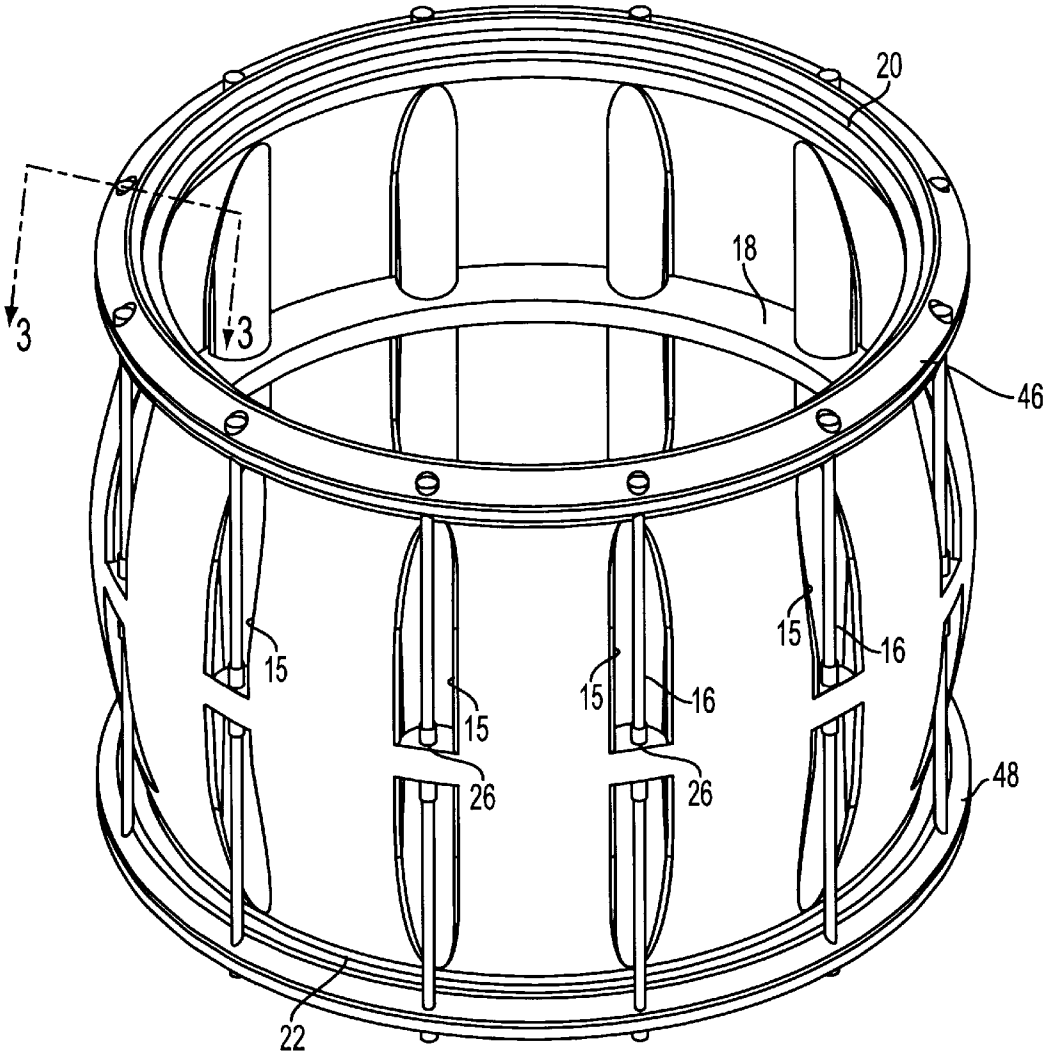
FIG. 2 is perspective view of the shell of FIG. 1, shown with tensioning members and end rings members attached thereto.
Figure 11:
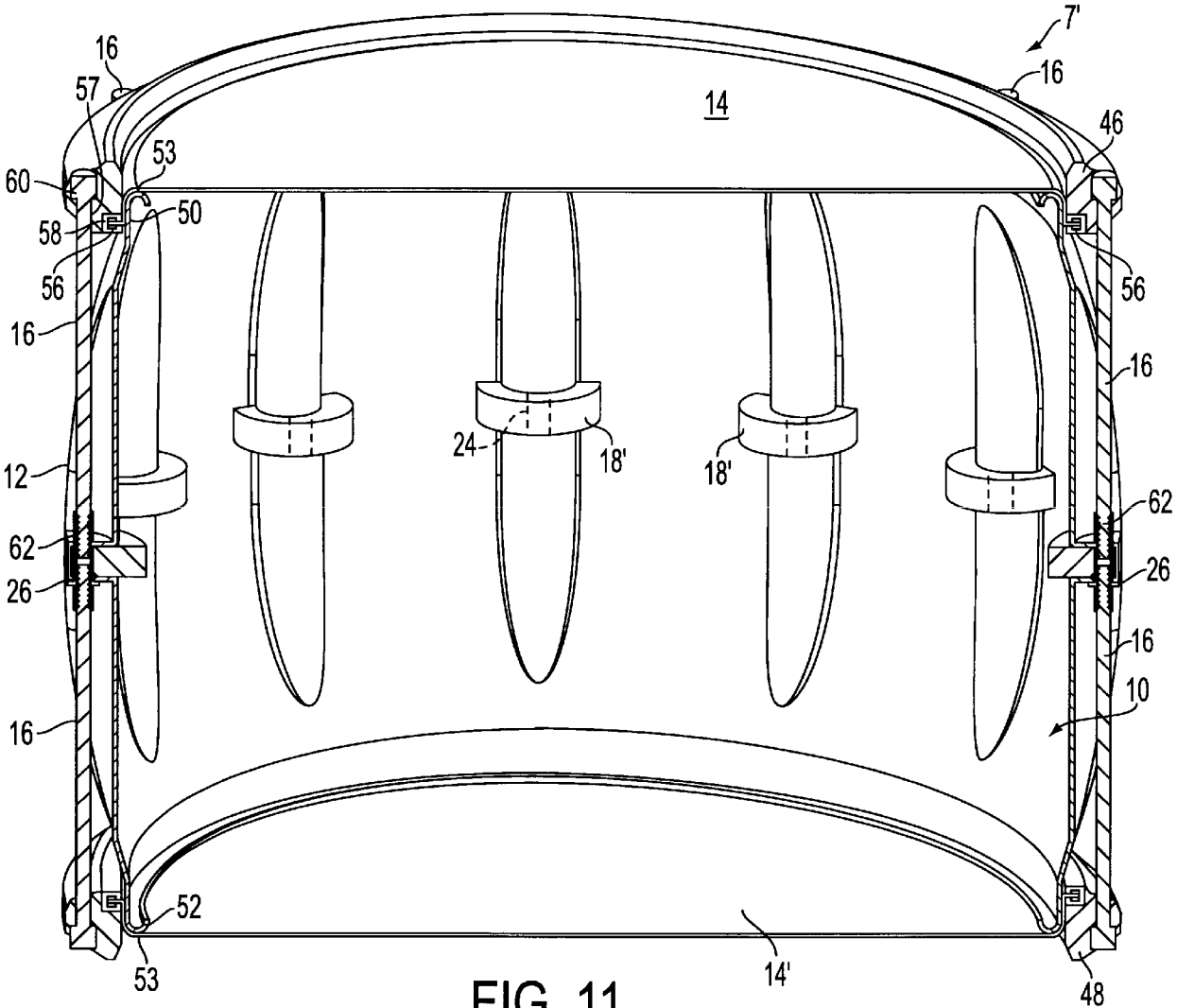
FIG. 11 is a perspective view of a portion of a drum showing a second embodiment of a reinforcing structure for reinforcing tension members.
Figure 12:
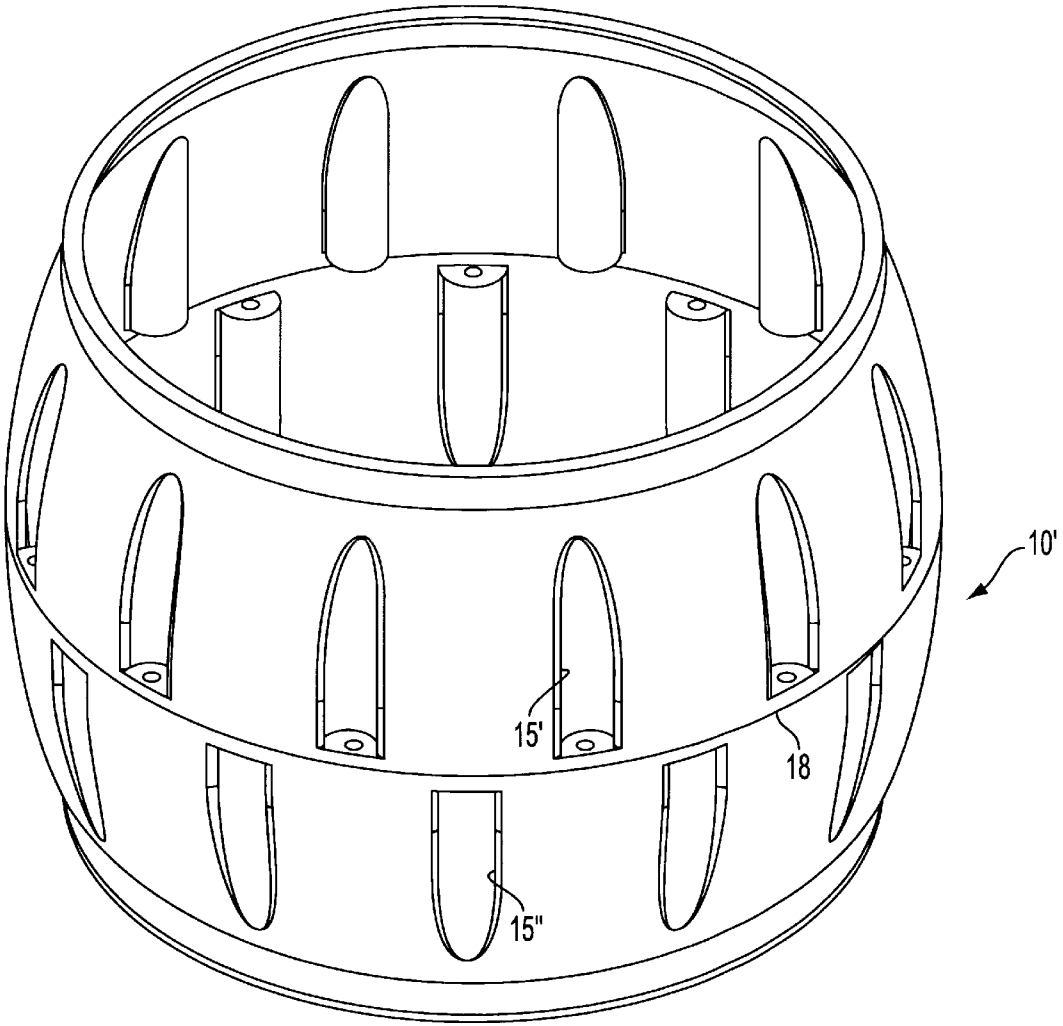
FIG. 12 is perspective view of another embodiment of the drum shell having channels in each side of the equator of the shell such that the channels on one side of the equator are offset with respect to channels on the other side of the equator.

A drum shell must provide the structural support for tensioning a drum head membrane but it must also be light in weight, comfortable, attractive and not detract from the musical qualities. Accordingly, with reference to FIG. 1, a drum shell, provided in accordance with the principles of the present invention is shown, generally indicated at 10. The drum shell 10 has a body 11 including an inner surface 13, and an outer surface 12. At least the outer surface 12 is of convoluted form that serves to increase the compressive moment of inertia so as to resist buckling induced by the axial tension applied to the drum membranes 14 and 14' (FIG. 11). In the illustrated embodiment, the outer shell 12 also has some convexity or bulges outwardly, but could be cylindrical. The convoluted form of the body 11 is formed by a plurality of channels 15 in the body 12. The channels 15 are elongated and extend in the direction of the axis A and also extend radially and open to the outer surface 12. In the embodiment of FIGS. 1 and 2, the channels 15 are evenly spaced about a periphery of the body 11 and are sized to receive drum tensioning members 16 therein. The structure and function of the tensioning members 16 will be explained below. With reference to FIG. 12, alternatively, channels 15' may be provided above an equator 18 of the shell 10' and channels 15" may be provided below the equator 18 such that the channels 15' and 15" are offset with respect to each other. Furthermore, the number of channels 15' above the equator 18 may be different from the number of channels 15" below the equator 18.

Figure 3:
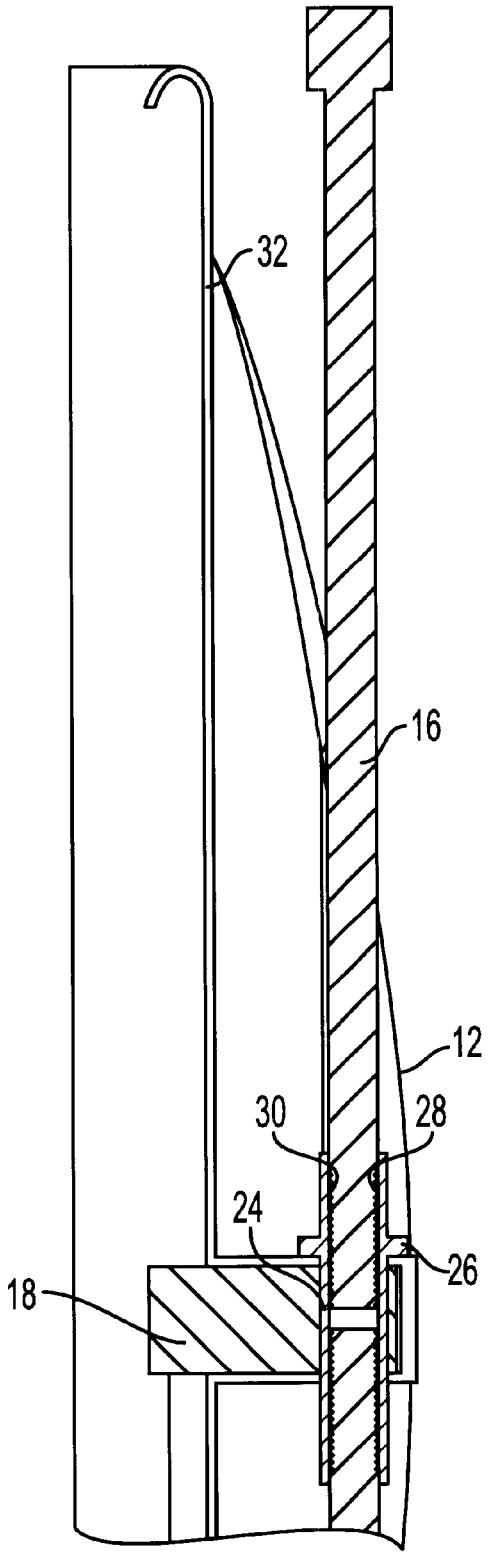
FIG. 3 is a section view taken along the line 3—3 of FIG. 2.
Figure 15:
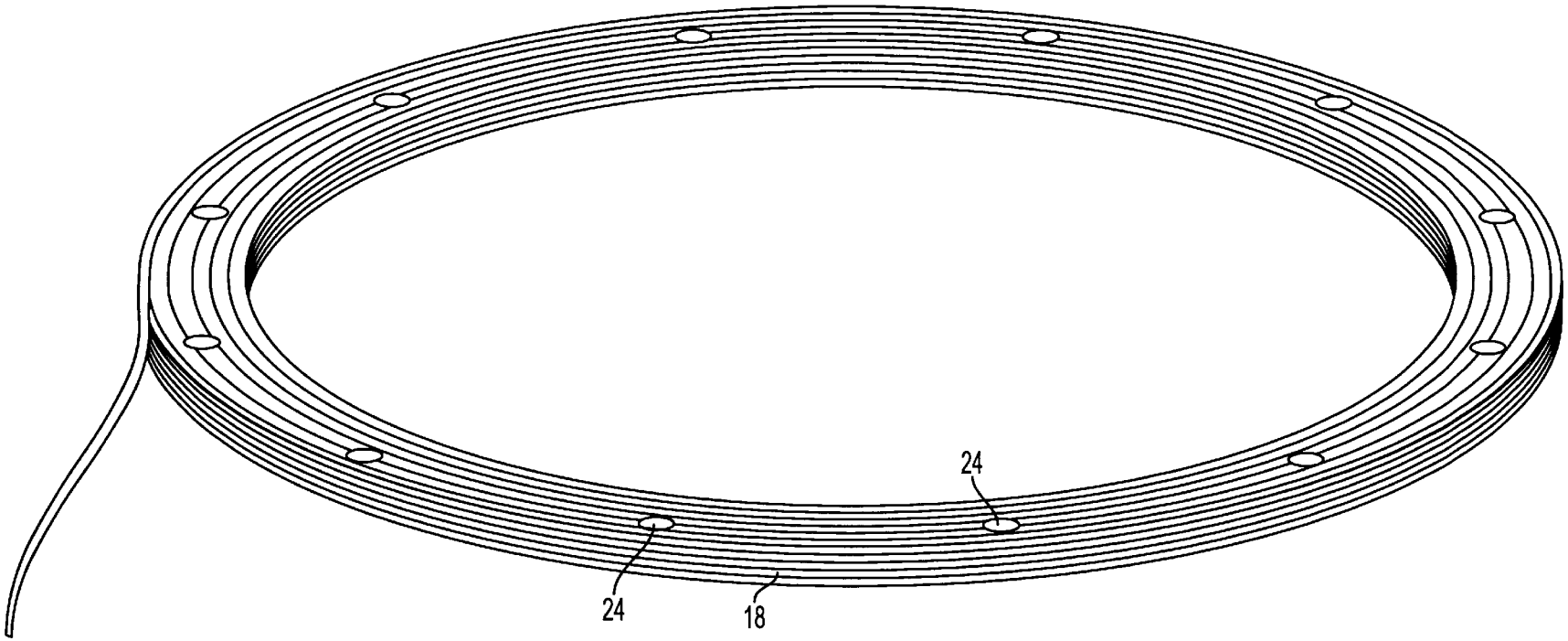
FIG. 15 is a perspective view of a filament wound ring defining reinforcing structure for reinforcing the tensioning members.

With reference to FIGS. 2 and 3, the channels 15 receive the tensioning members 16 and offer a means of positioning the load of the tensioning members 16 within the body 11. As shown in FIG. 2, a reinforcing structure 18, in the form of annular ring, is provided internally of the body 11, generally midway between ends 20 and 22 of the body 11. With reference to FIG. 15, the annular ring 18 is preferably wound from a continuous filament. Alternatively, the annular ring 18 can be a metal machined or a cast component laminated in place. The annular ring 18 includes a plurality of bores 24 therethrough, each for receiving an associated sleeve 26 (FIGS. 2 and 3). The annular ring 18 may be made integral with the body 11.

Referring to FIG. 3, each sleeve 26 is received in an associated bore 24 in the annular ring 18 and includes internal threads 28 for receiving an externally threaded end 30 of a tensioning member 16. The sleeves can be considered to be part of the annular ring 18. Thus, each tensioning member 16 passes through the annular ring 18 and is positioned approximately midway between the outer surface 12 of the body 11 and the inner surface 32 of the body 11 so as to distribute its load in a uniform manner over the convoluted shell. It can be appreciated that the sleeves 26 can be considered par of the annular ring. Alternatively, the sleeves can be omitted and the bores 24 can be internally threaded to receive the tensioning members 16.

As shown in FIG. 11, instead of providing the annular ring 18, the reinforcing structure can comprise a separate plate 18' associated with each channel 15. Each plate 18' includes a bore 24' therethrough for receiving an associated sleeve 26 (not shown). The plates 18' make possible the independent use of very short or very long tension members 16 for each individual end of the drum. The tension members 16 may be placed beyond the outer extremity of the shell 10 and still derive the stiffening benefit of the convoluted surface. It can be appreciated that the sleeves 26 can be considered to be part of the plate 18'. Alternatively, the sleeves 26 can be omitted and the bores 24' can be internally threaded to receive the tensioning members 16. Furthermore, the plates 18' can be made integral with the body 11.

It can be appreciated that the annular ring 18 or plate 18' can be omitted with the tension rods extending from end to end.

Figure 4A:
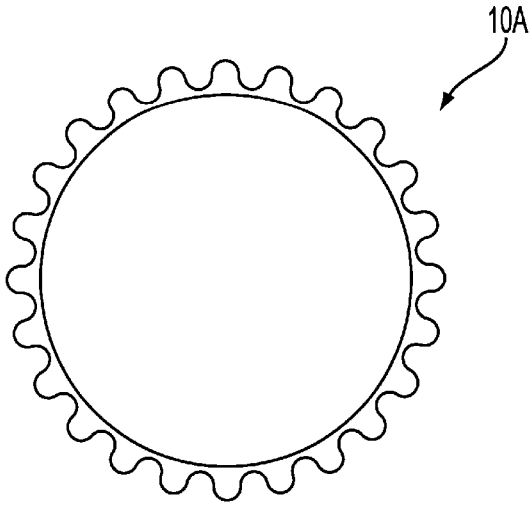
FIGS. 4A, 4B and 4C are plan views of alternate convoluted shell forms of the invention.
Figure 4B:
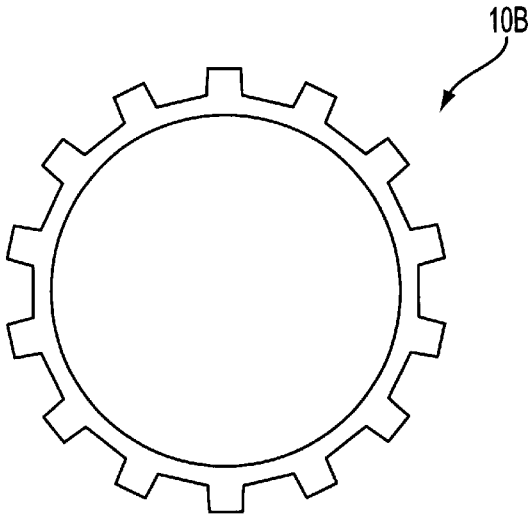
Figure 4C:
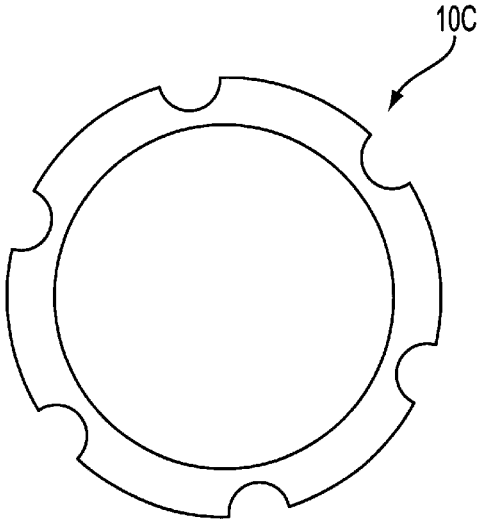
Figure 5A:
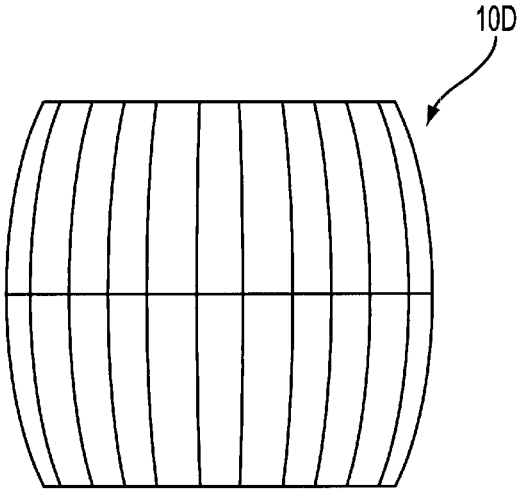
FIGS. 5A, 5B and 5C are side views of alternate convoluted shell forms of the invention.
Figure 5B:
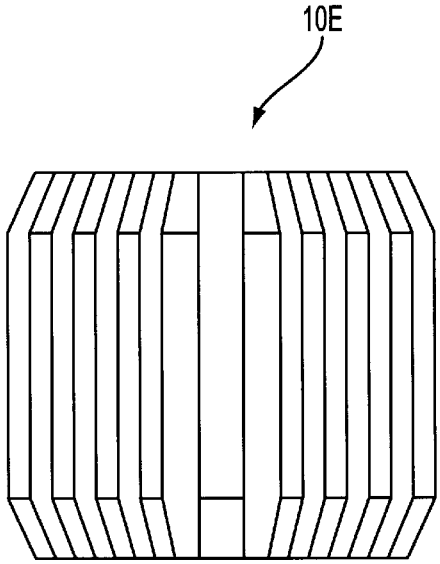
Figure 5C:
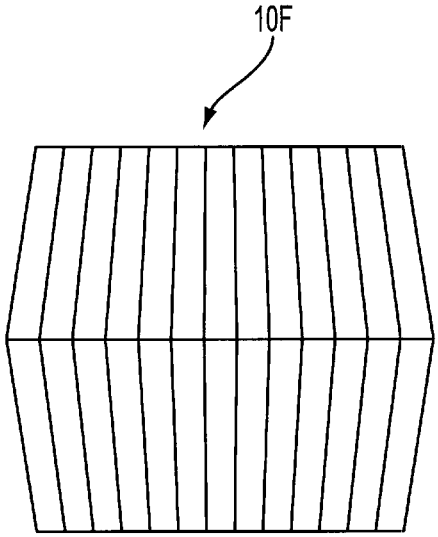

Various forms of surface convolutions of the shell 10 can be used of either regularly or irregularly pitched curvilinear or rectilinear forms as shown by shells 10A–10C of FIGS. 4A–4C or the shell can be of basically circular form as shown by shells 10, 10D–10F of FIGS. 1, 5A–5C.

With reference to FIG. 11, a section of a drum is shown generally indicated at 40. The drum 40 includes the drum shell 10, an upper ring 46 for clamping the upper membrane 14, and a lower ring 48 for clamping the lower membrane 14'. The body 12 has an upper rim 50 and a lower rim 52, each having a radiused membrane receiving surface 53. The assembly and tensioning of the drum 40 will be explained with regard to the upper portion of the drum 40 since the bottom portion of the drum 40 is assembled and tensioned in the same manner. Thus, the upper membrane 14 is stretched over the receiving surface 53 of the upper rim 50 to cover the open circular upper end of the body 11. A membrane holder 56 in the form of a ring is secured about the periphery of the upper membrane 14. The upper ring 46 is then placed over the membrane holder 56 such that the membrane holder 56 is received in a channel 58 of the upper ring 46. A plurality of tensioning members 16 are inserted through tension member receiving structure in the form of openings 57 in the upper ring with the heads 60 of the tensioning members 16 being seated on the upper ring 46. The threaded end 62 of each tensioning member 16 is threadedly engaged with an associated sleeve 26. Thus, the threaded engagement of the tensioning members 16 with the sleeves 24 adjusts the clamping force of the upper ring 46 and thus the tension of the upper membrane 14.

Figure 13:
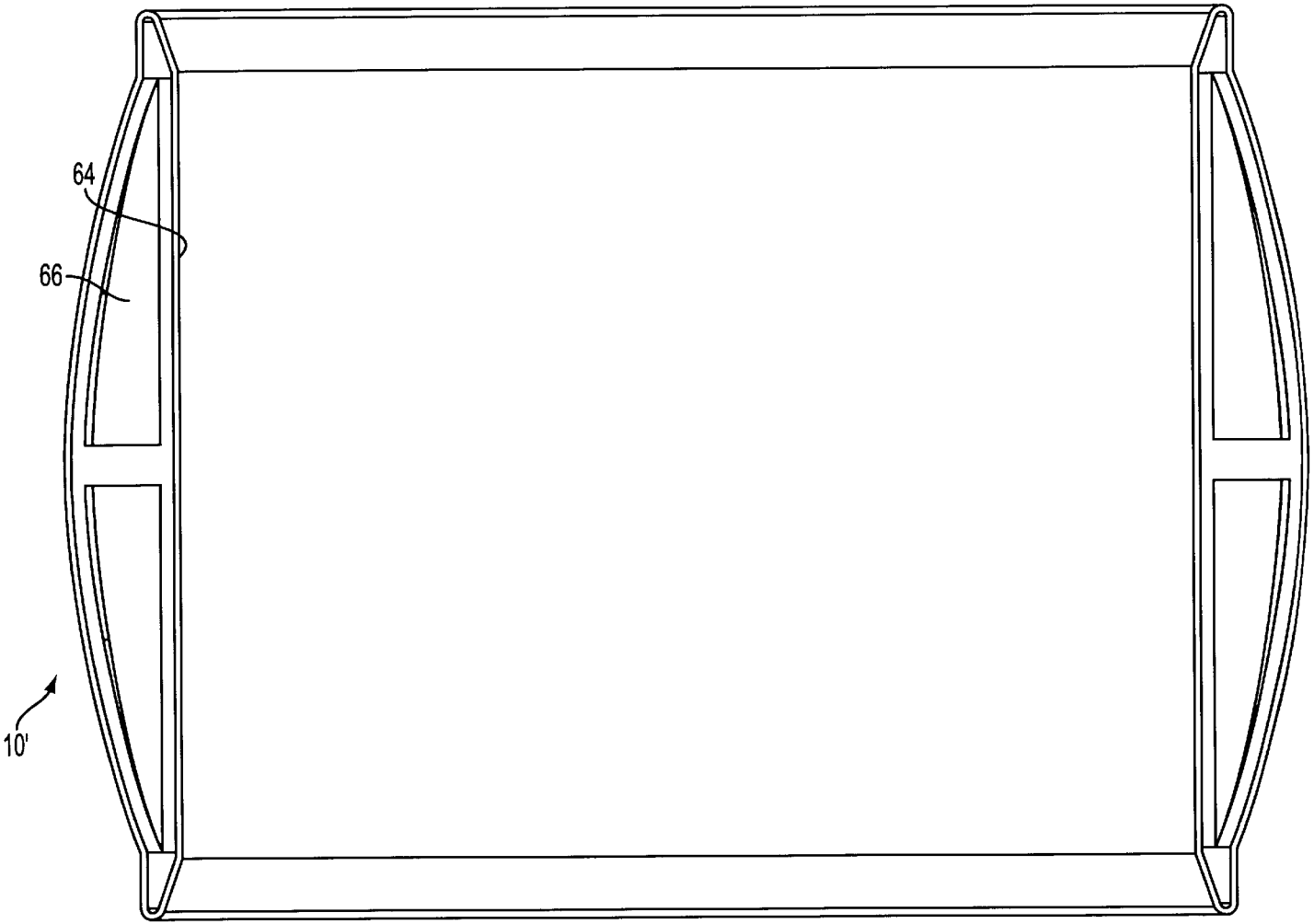
FIG. 13 is a view of a drum having an additional inner shell in accordance with the invention.
Figure 14:
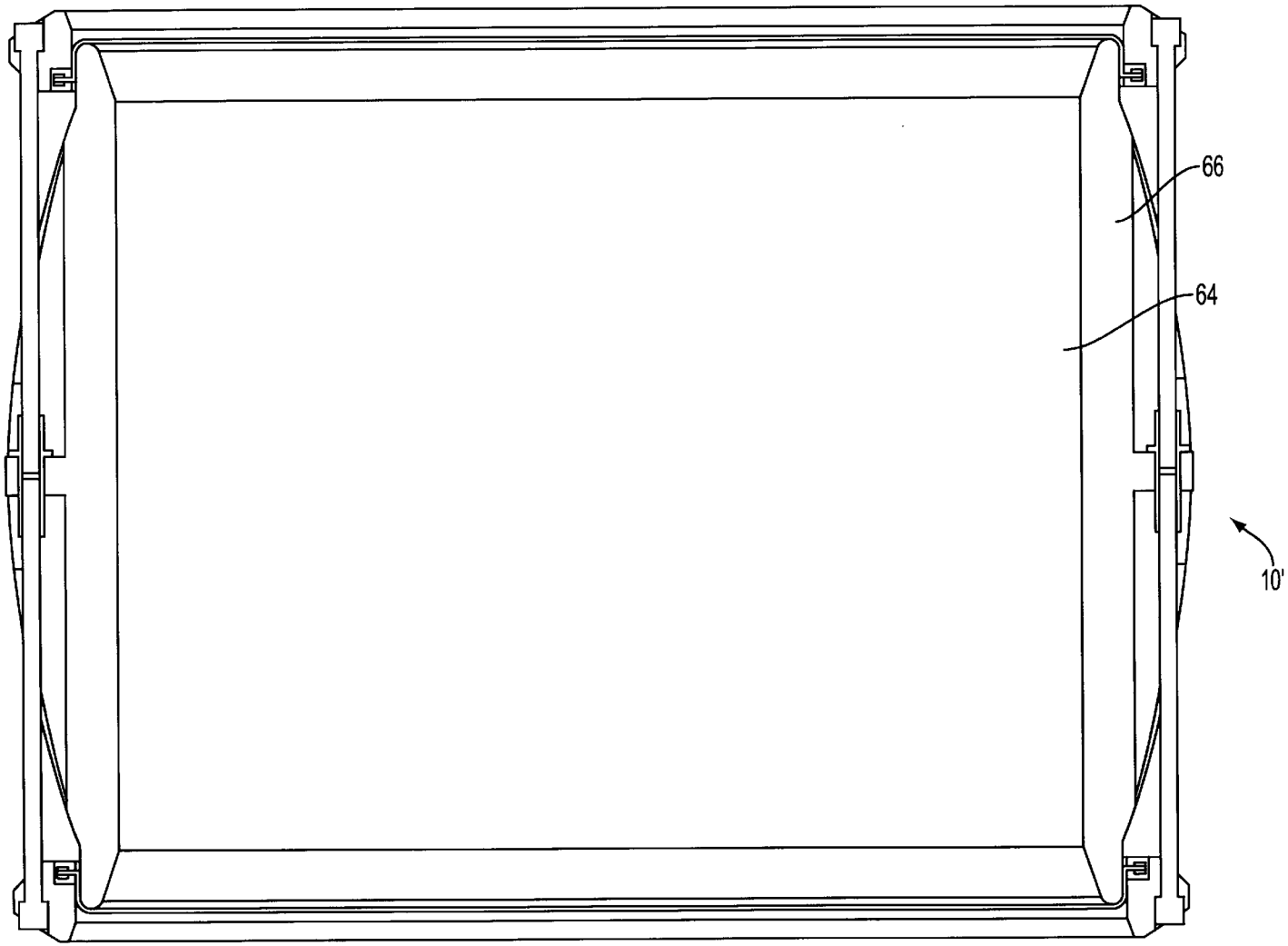
FIG. 14 is a view of the drum of FIG. 13 shown with material in a cavity between inner and outer shell walls.

As shown in FIGS. 13 and 14, an internal sleeve 34 can be added to the convoluted shell 10'. The sleeve 64 improves the compressive strength of the total shell 10' as well as its acoustic properties. The smooth interior resulting from the sleeve 64 will have less intrusive componentry to affect the vibration wave as it travels through the shell interior. A cavity 66 formed by the shell exterior and sleeve 64 may be filled as shown in FIG. 14 with media of various density to modify the sound quality. For example, the density may be changed to emulate a traditional wood shell or the damping can be increased to change the drum sound.

Lamination is the preferred method of manufacture as the convolutions of the shell 10 may easily be laid up in a separable mold. The laminate is constructed of fibrous cloth-like reinforcing material impregnated with resin and cured to a rigid thermoset matrix. The preferred materials are carbon fibres laid in an epoxy resin because these materials will provide the stiffest, strongest and lightest shell 10. However, various types of other reinforcing materials such as glass or even thermoplastic fibres such as aramid or polypropylene may be substituted for cost or sound properties. Other thermosetting resins such as polyester or vinyl ester may also be used to reduce cost. It is also possible to mold the shell from thermoplastic material with or without reinforcing fibres for cost, weight and strength advantages in instruments with lower tension requirements.

The shell 10 may also be formed of thin metal that has the convoluted shape drawn or impressed into the surface. This may be done by using a female die and pressing each half of the shell from a flat sheet with a matching male punch or with hydraulic pressure applied via a flexible membrane in a method known as hydroforming. The entire shell 10 may be formed by placing a tubular plain walled shell in a hydroforming press that has an external upper and lower die and an internal rubber bladder pressurized with hydraulic fluid. It is also possible to roll the shape into the metal surface as is done for rolled sprockets and gears.

Figure 6:
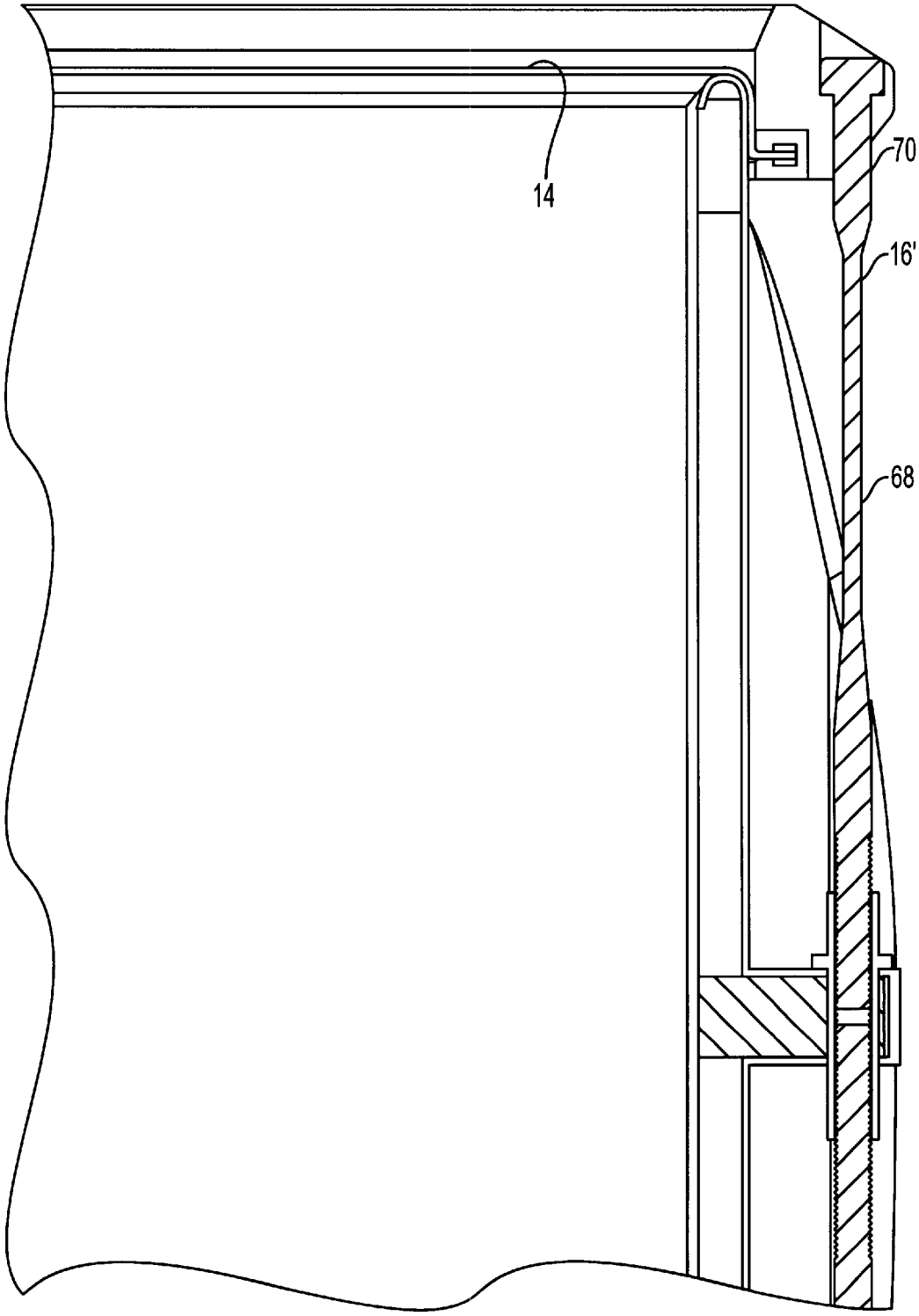
FIG. 6 is a sectional view of a tensioning member of the invention having a decreased cross section.
Figure 7:
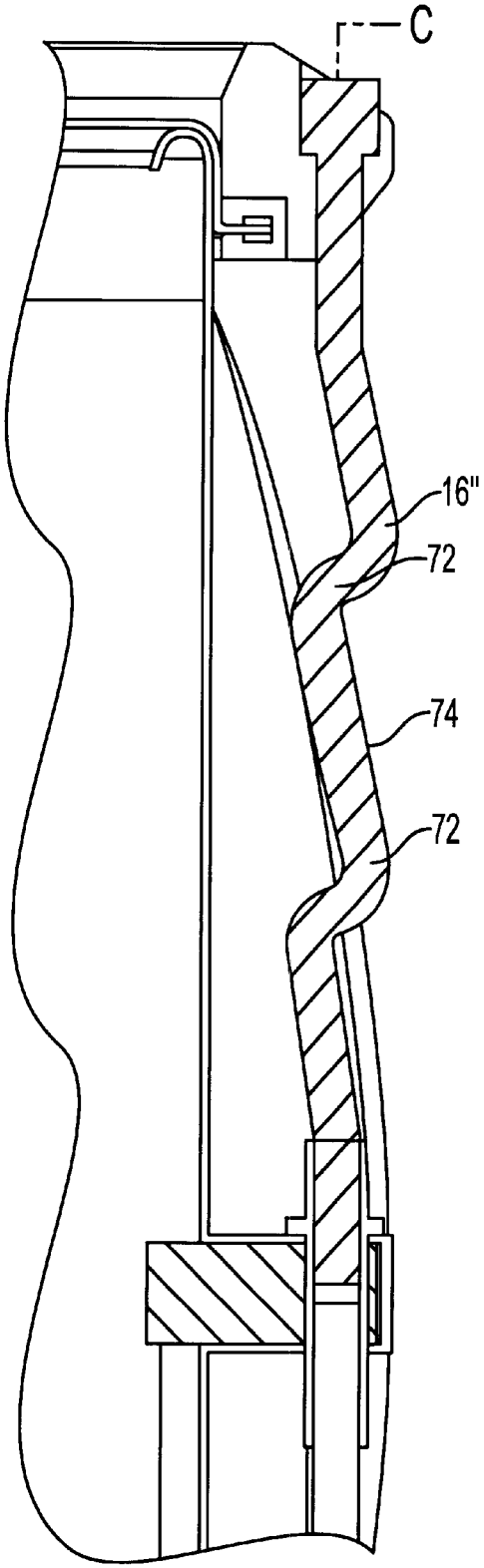
FIG. 7 is a sectional view of a tensioning member of the invention having a bending portion.

The tensioning members 16 must be made strong enough to exert the tension needed to tune the membranes 14 and 14' and this generally renders them quite stiff. However, it would be advantageous if the tensioning system were very elastic as this would minimize any tension change as a result of shrinking or stretching of the membrane. Hence, in accordance with the disclosed embodiment, the tensioning system is made very elastic by one of several means. FIG. 6 shows a tensioning member 16' which is configured in the manner of a "stretch bolt". The shank diameter 68 is reduced in diameter (as compared to diameter 70) to approximately the thread root diameter and the body is elongated so as to increase the stretch incurred in tensioning, maintaining the membrane 14 tension should the membrane stretch or contract. In FIG. 7, the tensioning member 16" is shown having a series of bends 72 in the shank 74 relative to axis C. By means of increasing the number of bends and the length of the transverse sections in tensioning member 16" , the tensioning member 16" can be made increasingly more elastic. It is also possible to form the tensioning member as a tension spring to achieve a similar effect. Each tensioning member 16 is preferably made of material having a tensile modulus lower than steel.

Figure 8A:
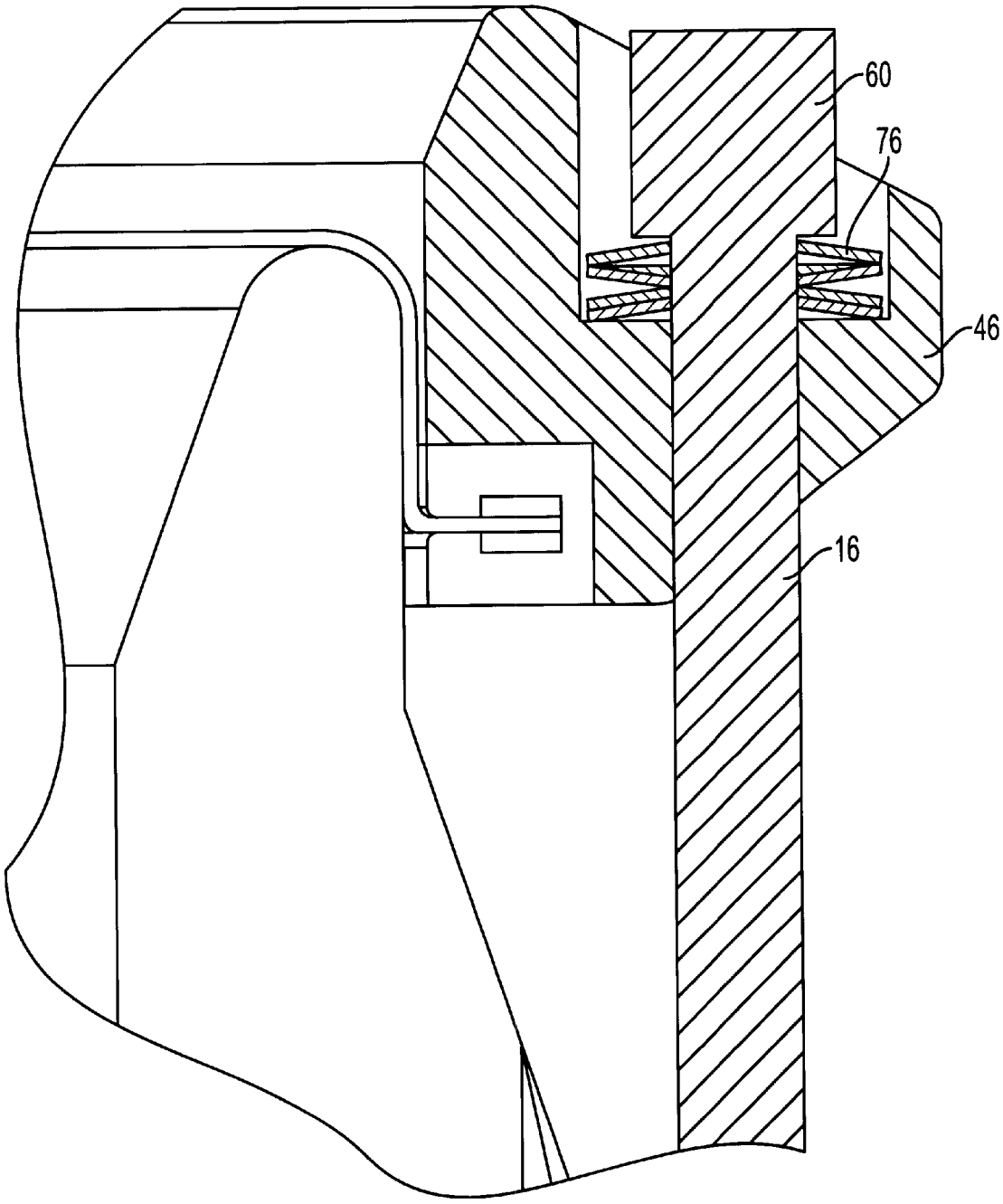
FIG. 8A is sectional view of a tensioning member shown with spring structure associated a head portion thereof.
Figure 8B:
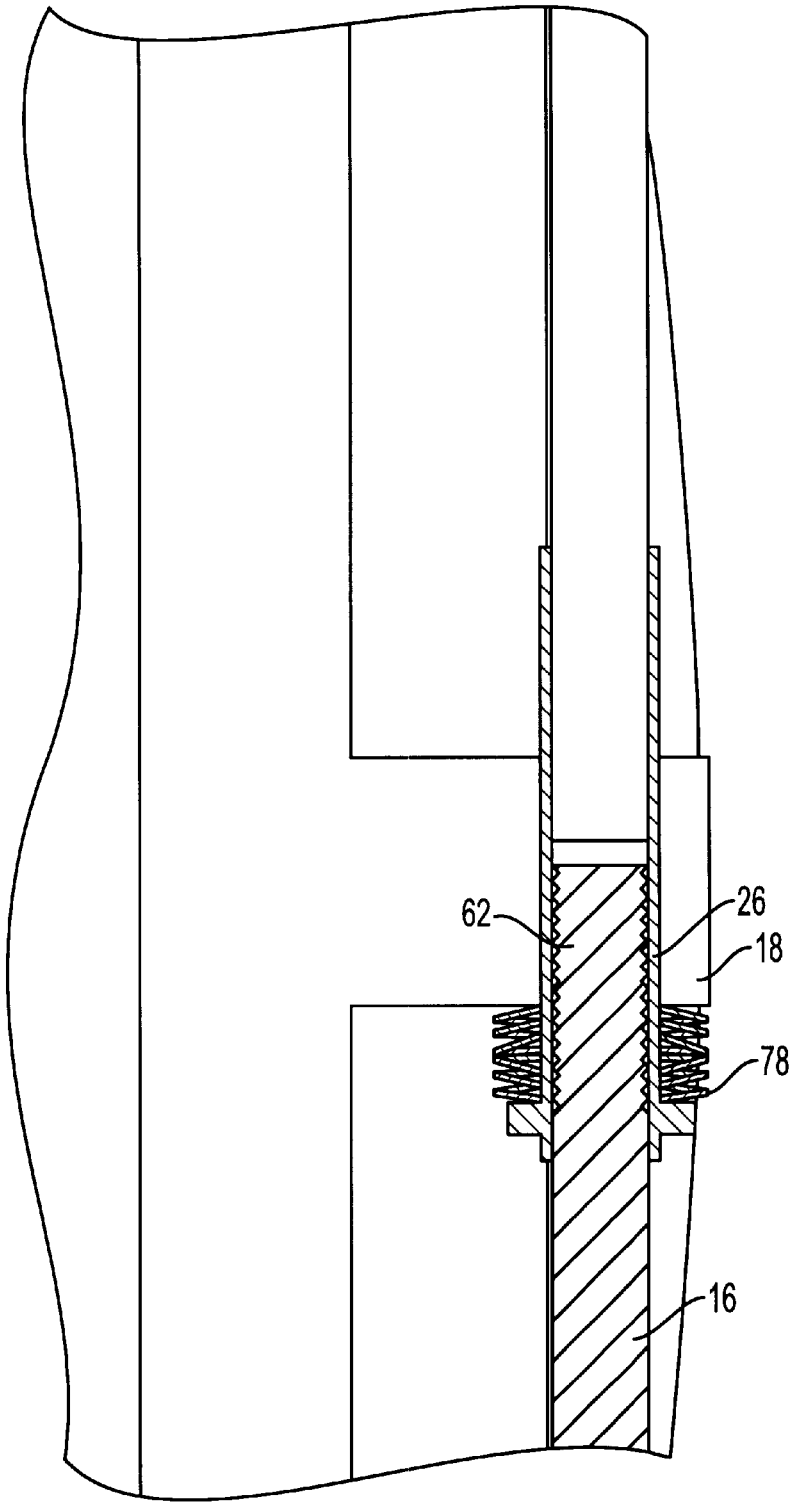
FIG. 8B is a sectional view of a tensioning member and sleeve shown with spring structure associated with the sleeve.

The tensioning member 16 may also have spring structure associated therewith. For example, as shown in FIG. 8A, disc spring structure 76 known as a "Belleville washers" is placed in series with the tensioning member 16. More particularly, the spring structure 76 is placed between the head 60 of the tensioning member 16 and the upper ring 46. It can be appreciated that the spring structure 76 can be provided with the tensioning members 16 associated with the lower ring 48 as well. Furthermore, spring structure 78 can be provided near the threaded end 62 of the tension member 16. Thus, FIG. 8B shows the spring structure 78 between the sleeve 26 and the annular ring 18. Disc spring characteristics are very suitable for this application since they have the unique property of reducing their spring rate as the load increases. The rate of a spring is the ratio of applied force to its deflection. In the case of a tensioning member 16, it is desirable to have a low spring rate which means that tension would be less with either lengthening or shortening the tensioning member 16 and thus the tension in the membranes 14, 14' would be changed less should the membranes expand or contract.

Figure 9:
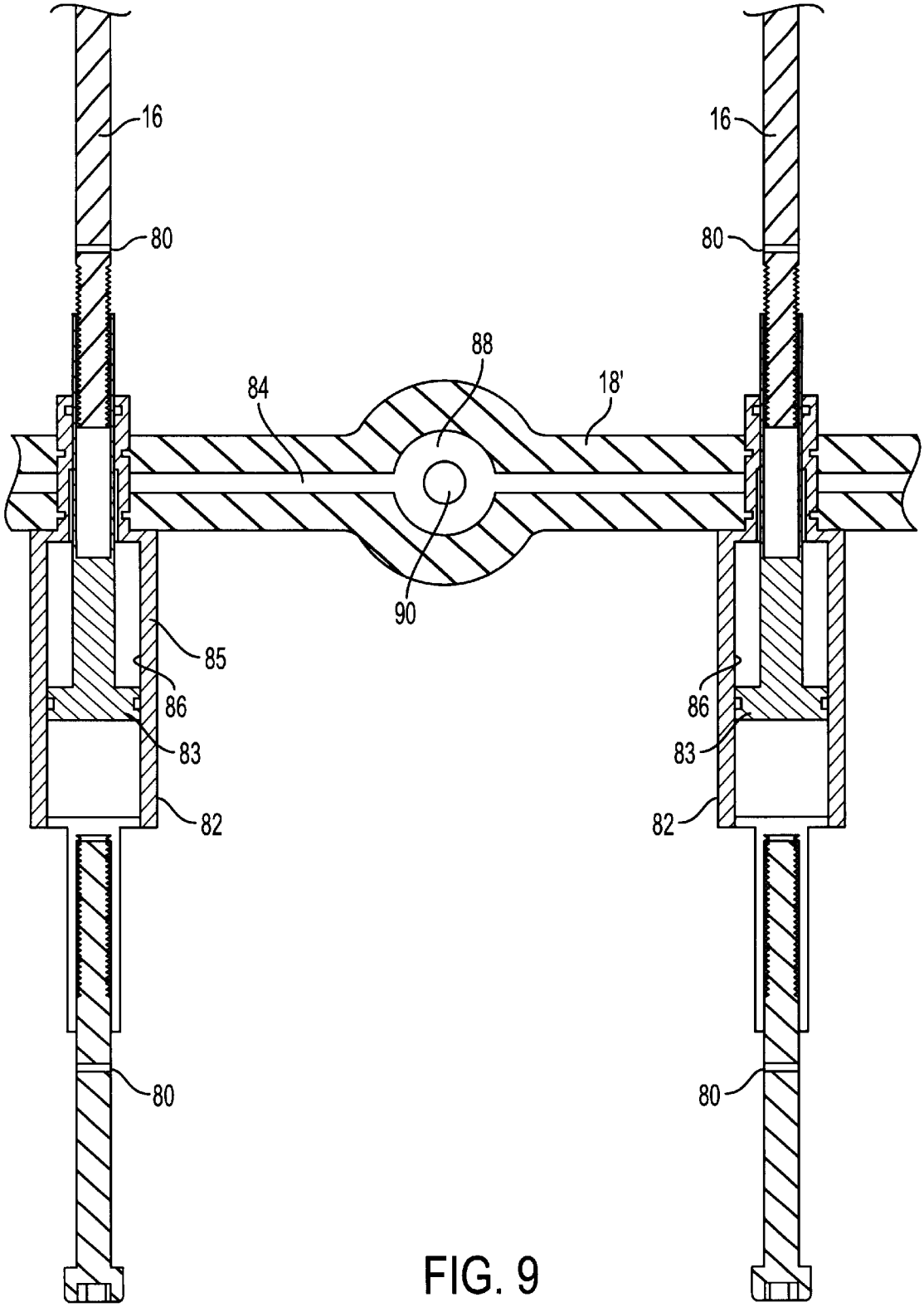
FIG. 9 is a sectional view of a fluid actuator system and tension marks associated with the tension members to confirm adjustment of the tensioning members.

The disc spring structure 76 and 78 is also suitable for the purpose of changing the maximum tension force attainable at their limit of compression by adding or subtracting discs from the stack. When a greater degree of elasticity is introduced to the tensioning system, there is a concurrent increase in the displacement of the threaded adjusting end of the tensioning member 16 and this makes it possible to more accurately indicate the amount of tension existing in the member 16. Hence, in accordance with the disclosed embodiment as shown in FIG. 9, a visual indicator is provided on each tensioning member 16 which indicates existing tension by comparing the displacement of the threaded member 16 through its adjusting sleeve 26 by means of a graduated visual indicator 80. Thus, it is possible for a user to estimate the tensioning member displaced length and accordingly the tension in the tensioning member 16.

Figure 10:
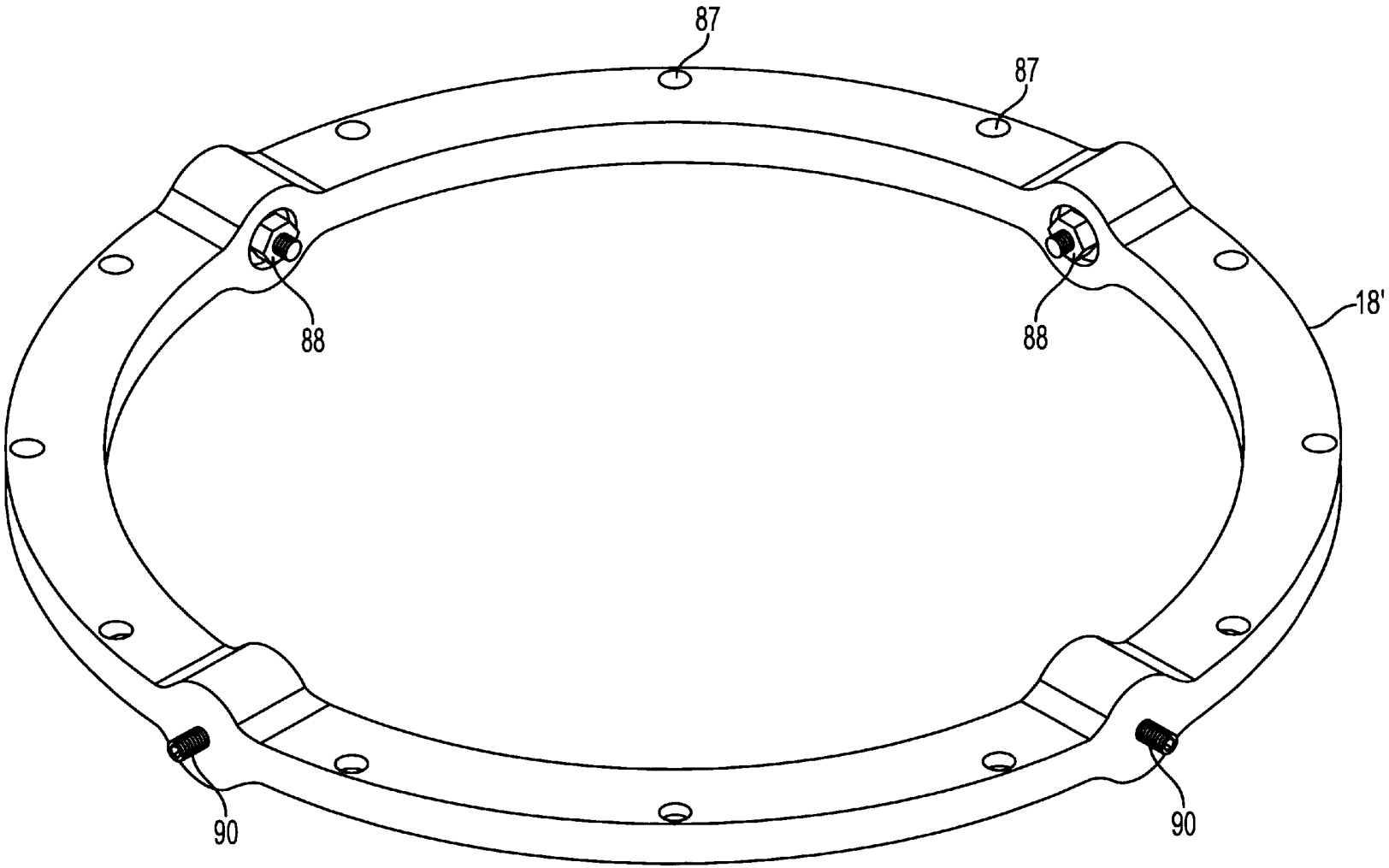
FIG. 10 is perspective view of a multiport filling system to add fluid and bleed fluid from the fluid actuator system of FIG. 9.

Finally, it is important to provide a means of easily achieving uniform tensioning of all of the tensioning members 16. Hydraulic tensioning has been known in the art and while it provides both a means of adjusting the tension and insuring uniform loading, it does so with the input of pressure from an external source. This entails a complicated arrangement of separate cylinders, pipes, and a master cylinder which increases the weight, size and cost of the instrument. In many applications it is not necessary to adjust the tonal properties continuously while playing but only to easily achieve uniform tension when tuning the drum. The invention addresses this need by placing a small hydraulic actuator 82 at the end of each tension member 16 as shown in FIG. 9. Each actuator 82 includes a piston 83 movable in a cylinder 85 by fluid. All actuators 82 are interconnected via a channel 84 so all actuators 82 share the same pressure and thus have the same tension. However, there is no external input of pressure. The act of tightening each tension member 16 serves to increase the hydraulic pressure in chamber 86. As long as each tensioning member 16 is adjusted more or less uniformly, the tension remains the same in all members 16. Furthermore, the channels of the convoluted exterior shell 10 surface provide a recessed space within which to mount hydraulic actuators 82. Furthermore, with reference to FIG. 10, the annular ring 18' not only anchors the actuators 82 via mounting holes 87, but ideally acts as a manifold providing a means of hydraulic interconnection without the use of external pipes or hoses and the attendant risk of leakage.

In any hydraulic system it is necessary to be able to purge air. Thus, the ring 18' includes bleeders 88 and filling ports 90. When bleeding, it is necessary to be able to position the air escape port above the actuator 82 and to have a relatively short path for air to exit from each actuator 82. Multiple ports assure that this is possible.

Instead of using hydraulic cylinders, diaphragms can also be used to enable uniform tensioning of all tensioning members 16.

Thus, the invention allows the differential tensioning of the vibrating membranes 14, 14' stretched over the open ends of the tubular shell 10. This differential tension is not only necessary to purposely produce different vibration qualities from the membranes 14, 14', but due to differences in the membranes or mechanical differences in the tensioning, it is essential in order to produce the same or similar sound properties in the membranes 14, 14'.

The shape of the shell 10 and its construction increases the buckling strength and thus permits the use of thinner material for the shell than previously possible.

Also, manufacturing and forming the material into the required shape is now easier. By enabling the shell to withstand the loads and by feeding the loads directly into the body of the shell, the active participation of the shell in the vibration amplification, process ensures that the sound quality of the drum is improved. Because the shell structure is receiving all of the loads and vibration directly and not through any bracketry the sound quality is actually enhanced over any previous design that could withstand the high tension demands.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A drum shell comprising:

a rigid, hollow body having first and second opposing opened ends for receiving drum heads to cover the open ends, the body having an inner surface and an outer surface, at least the outer surface being of convoluted form, wherein the convoluted form is defined by elongated channels in the body, the channels extending towards said ends.

2. The drum shell of claim 1, wherein the channels extend radially to the outer surface.

3. The drum shell of claim 1, wherein the channels are evenly spaced about a periphery of the body and are sized to receive drum tensioning members therein.

4. The drum shell of claim 1, wherein reinforcing structure is provided in each channel, the reinforcing structure including a bore therethrough associated with each channel for receiving a drum tensioning member.

5. The drum shell of claim 4, wherein the reinforcing structure is an annular member mounted to the body between the opposing ends.

6. The drum shell of claim 4, wherein the reinforcing structure includes a separate plate member disposed in each said channel.

7. The drum shell of claim 1, further comprising a rigid inner sleeve disposed within the hollow body so as to define a cavity between the inner sleeve and the body.

8. The drum shell of claim 7, further including a material at least partially filling the cavity.

9. The drum shell of claim 1, wherein the outer surface is a substantially smooth surface.

10. A drum comprising:

a rigid, hollow body having first and second opposing opened ends of generally circular form, the body having an inner surface and an outer surface, the outer surface being of convoluted form defined by a plurality of channels formed in the body, the channels extending toward said ends, a drum head membrane covering each of the first and second ends, a ring mounted on each of the first and second ends so as to secure each drum head membrane to the body, each ring including a tensioning member receiving structure, and a plurality of tensioning members, a tensioning member being received in an associated channel and a first end of each tensioning member being received by the tensioning member receiving structure of each ring, said tensioning members being constructed and arranged to be moved with respect to the body to adjust tension of the drum head membranes.

11. The drum of claim 10, wherein the channels extend radially to the outer surface.

12. The drum of claim 10, wherein the channels are evenly spaced about a periphery of the body.

13. The drum of claim 10, wherein reinforcing structure is provided in each channel, the reinforcing structure including internal threads associated with each channel for receiving a threaded end of an associated tensioning member.

14. The drum of claim 13, wherein the reinforcing structure is an annular member mounted to the body substantially midway between the opposing ends.

15. The drum of claim 14, wherein the threaded end of the each tensioning member is externally threaded and is threadedly engaged with internal threads, such that by adjusting the threaded engagement of the tensioning members with internal threads, the stretching tension on the drum head membranes can be adjusted.

16. The drum of claim 13, wherein the reinforcing structure includes a separate plate member disposed in each channel.

17. The drum of claim 16, wherein the threaded end of each tensioning member is externally threaded and is threadedly engaged with the internal threads, such that by adjusting the threaded engagement of the tensioning members with the sleeves, the stretching tension on the drum head membranes can be adjusted.

18. The drum of claim 10, further comprising a rigid inner sleeve disposed within the hollow body so as to define a cavity between the inner sleeve and the body.

19. The drum of claim 18, further including a material at least partially filling the cavity.

20. The drum of claim 10, wherein the outer surface is a substantially smooth surface.

21. The drum of claim 10, wherein each tensioning member has a threaded end having a certain pitch diameter, a portion of the tensioning member having a diameter less than the pitch diameter.

22. The drum of claim 10, wherein each tensioning member has a longitudinal axis and has a portion that is bent with respect to the axis.

23. The drum of claim 10, wherein each tensioning member is of a material having a tensile modulus lower than steel.

24. The drum of claim 13, further including spring structure between each sleeve and the reinforcing structure so as to be compressed when a tensioning member is threadedly engaged with the internal threads.

25. The drum of claim 10, wherein the first end of each tensioning member includes a head, and a spring structure is provided between the head of each tensioning member and a surface defining an associated tensioning member receiving structure.

26. The drum of claim 10, further comprising hydraulic means for balancing tension of the tensioning members, the means for balancing including a fluid chamber associated with each tensioning member, the fluid chambers being interconnected so as to share fluid pressure as the tensioning members are moved.

27. The drum of claim 27, wherein the means for balancing includes a piston and cylinder arrangement associated with each tensioning member.

28. The drum of claim 26, wherein reinforcing structure is provided in each channel, the reinforcing structure being in the from of an annular member mounted to the body substantially midway between the opposing ends, the annular member including internal threads associated with each channel for receiving a threaded end of an associated tensioning member, movement of the tensioning member with respect to the internal threads causing changes in the fluid pressure.

29. The drum of claim 28, wherein the annular ring defines a manifold to fluidly interconnect the fluid chambers.

30. The drum of claim 29, wherein the manifold includes an air bleed port and a fluid fill port.

31. The drum of claim 10, wherein reinforcing structure is provided in each channel, the reinforcing structure including a internal threads associated with each channel for receiving a threaded end of an associated tensioning member.

32. The drum of claim 31, wherein each tensioning member includes a visual indicator indicative of an amount of threaded engagement of the tensioning member.

* * * * *